US009666961B2

(12) United States Patent
Horning et al.

(10) Patent No.: US 9,666,961 B2
(45) Date of Patent: May 30, 2017

(54) ELECTRICAL CONNECTOR

(71) Applicant: TYCO ELECTRONICS CORPORATION, Berwyn, PA (US)

(72) Inventors: Michael James Horning, Lancaster, PA (US); Leo Joseph Graham, Hershey, PA (US); Wayne Samuel Davis, Harrisburg, PA (US); Bruce Allen Champion, Camp Hill, PA (US); Dave Helster, Dauphin, PA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/844,674

(22) Filed: Sep. 3, 2015

(65) Prior Publication Data

US 2017/0069986 A1 Mar. 9, 2017

(51) Int. Cl.
*H01R 12/70* (2011.01)

(52) U.S. Cl.
CPC ..... *H01R 12/7076* (2013.01)

(58) Field of Classification Search
CPC ..... H01R 12/52; H01R 12/716; H01R 9/096; H01R 13/6599; H01R 13/6586
USPC ..... 439/74, 88, 607.02, 607.03
See application file for complete search history.

(56) References Cited

U.S. PATENT DOCUMENTS

| | | | | |
|---|---|---|---|---|
| 7,371,117 | B2 | 5/2008 | Gailus | |
| 7,503,773 | B2 * | 3/2009 | Tokunaga | H01R 12/58 439/108 |
| 7,985,079 | B1 * | 7/2011 | Wilson | H01R 12/52 439/74 |
| 8,187,035 | B2 * | 5/2012 | Davis | H01R 12/724 439/607.02 |
| 8,535,065 | B2 * | 9/2013 | Costello | H01R 13/6585 439/607.03 |
| 9,531,133 | B1 * | 12/2016 | Horning | H01R 13/6585 |
| 2015/0140865 | A1 * | 5/2015 | Wickes | H01R 9/2408 439/607.28 |
| 2016/0099532 | A1 * | 4/2016 | Davis | H01R 13/6585 439/357 |

* cited by examiner

*Primary Examiner* — Tulsidas C Patel
*Assistant Examiner* — Marcus Harcum

(57) ABSTRACT

An electrical connector includes a housing stack comprising a front housing and a rear housing coupled to the front housing at a seam. The housing stack defines plural contact cavities that extend continuously through the front housing and the rear housing between mating and mounting ends. A lossy spacer is disposed at the seam between the front and rear housings. The lossy spacer has plural contact cavities aligned with corresponding contact cavities of the housing stack. Signal and ground contacts are disposed in corresponding contact cavities of the housing stack. The signal contacts extend through the lossy spacer such that the signal contacts do not directly engage the lossy spacer. The ground contacts extend through the contact cavities in the lossy spacer such that the ground contacts are coupled by the lossy spacer.

20 Claims, 4 Drawing Sheets

ELECTRICAL CONNECTOR

BACKGROUND OF THE INVENTION

The subject matter herein relates generally to electrical connectors.

Some electrical connector systems utilize electrical connectors, such as mezzanine connectors, to interconnect two circuit boards, such as a motherboard and daughter card. The conductors of one electrical connector are terminated to one circuit board and extend through the housing towards a mating end to engage mating conductors of the mating connector terminated to the other circuit board.

Some known electrical connectors have electrical problems, particularly when transmitting at high data rates. For example, the electrical connectors typically utilize differential pair signal conductors to transfer high speed signals. Ground conductors improve signal integrity. However, electrical performance of known electrical connectors, when transmitting the high data rates, is inhibited by resonance spikes, such as at high frequencies.

A need remains for a high density, high speed electrical connector assembly having reliable performance.

BRIEF DESCRIPTION OF THE INVENTION

In an embodiment, an electrical connector is provided including a housing stack comprising a front housing and a rear housing. The front housing defines a mating end of the housing stack configured for mating with a mating connector and the rear housing defines a mounting end of the housing stack configured for mounting to a circuit board. The mounting end is opposite the mating end. The rear housing is disposed rearward of the front housing and is coupled to the front housing at a seam. The housing stack defines plural contact cavities that extend continuously through the front housing and the rear housing between the mating end and the mounting end. A lossy spacer is disposed at the seam between the front and rear housings. The lossy spacer has plural contact cavities aligned with corresponding contact cavities of the housing stack. Signal contacts are disposed in corresponding contact cavities of the housing stack and are provided at or near the mating and mounting ends for electrical connection to the mating connector and circuit board, respectively. Ground contacts are disposed in corresponding contact cavities of the housing stack and are provided at or near the mating and mounting ends for electrical connection to the mating connector and circuit board, respectively. The signal contacts pass through the lossy spacer such that the signal contacts do not directly engage the lossy spacer. The ground contacts pass through the contact cavities in the lossy spacer such that the ground contacts are coupled by the lossy spacer.

In another embodiment, an electrical connector is provided including a housing stack having a front housing and a rear housing disposed rearward of the front housing and being coupled to the front housing at a seam. The front housing defines a mating end of the housing stack configured for mating with a mating connector. The rear housing defines a mounting end of the housing stack configured for mounting to a circuit board. The housing stack defines plural contact cavities that extend axially through the front housing and the rear housing between the mating end and the mounting end. Signal contacts and ground contacts are disposed in corresponding contact cavities of the housing stack and are provided at or near the mating and mounting ends for electrical connection to the mating connector and circuit board, respectively. The signal contacts are arranged in signal rows along signal row axes and the ground contacts are arranged in ground rows along ground row axes. The electrical connector includes a lossy spacer having a plurality of strips disposed at the seam between the front and rear housings. The strips are generally parallel to each other and separated by gaps. The strips are aligned with the ground row axes and the gaps are aligned with the signal row axes. The signal contacts pass through the gaps in the lossy spacer such that the signal contacts do not directly engage the lossy spacer. The ground contacts pass through the strips of the lossy spacer such that the ground contacts are coupled by the lossy spacer.

In a further embodiment, an electrical connector is provided including a housing stack having a front housing and a rear housing disposed rearward of the front housing and being coupled to the front housing at a seam. The front housing defines a mating end of the housing stack configured for mating with a mating connector. The rear housing defines a mounting end of the housing stack configured for mounting to a circuit board. The housing stack has opposite first and second sides and opposite first and second ends extending between the mating and mounting ends. The housing stack defines plural contact cavities that extend axially through the front housing and the rear housing between the mating end and the mounting end. The electrical connector includes a lossy spacer having a plurality of strips disposed at the seam between the front and rear housings. The strips are generally parallel to the first and second sides. The strips are separated by gaps. The strips have plural contact cavities aligned with corresponding contact cavities of the housing stack. Signal contacts are disposed in corresponding contact cavities of the housing stack and are provided at or near the mating and mounting ends for electrical connection to the mating connector and circuit board, respectively. Ground contacts are disposed in corresponding contact cavities of the housing stack and are provided at or near the mating and mounting ends for electrical connection to the mating connector and circuit board, respectively. The signal contacts pass through the gaps in the lossy spacer such that the signal contacts do not directly engage the lossy spacer. The ground contacts pass through corresponding contact cavities in the strips of the lossy spacer such that the ground contacts are coupled by the lossy spacer.

DETAILED DESCRIPTION OF THE INVENTION

Figure 1:
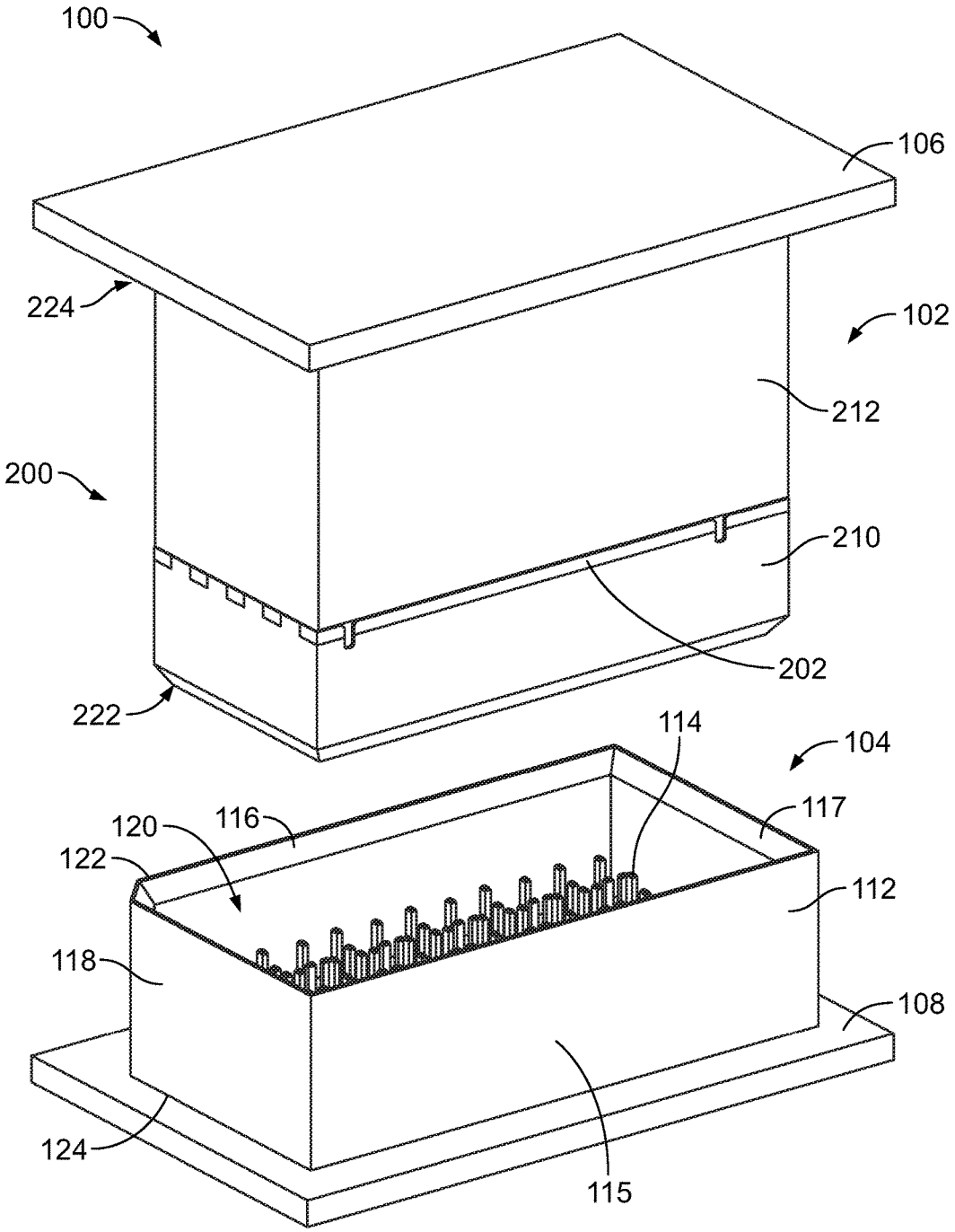
FIG. 1 is a top perspective view of an electrical connector system including an electrical connector formed in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. The electrical connector system 100 may be disposed on or in an electrical component, such as a server, a computer, a router, or the like. In FIG. 1, the first electrical connector 102 and the second electrical connector 104 are shown un-mated, but poised for mating to one another.

In an exemplary embodiment, the first electrical connector 102 is a mezzanine connector, and the second electrical connector 102 is a header connector. The electrical connectors 102, 104 may be referred to herein as mezzanine connector 102 and header connector 104, respectively; however the subject matter described herein is not intended to be limited to mezzanine connectors but rather may have application to other types of connectors in alternative embodiments, such as right angle connectors or other types of connectors.

The first electrical connector 102 and the second electrical connector 104 are configured to be electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the first electrical connector 102 is mounted to the first circuit board 106, and the second electrical connector 104 is mounted to the second circuit board 108. In an embodiment, the first and second circuit boards 106, 108 are oriented parallel to one another when the first and second electrical connectors 102, 104 are mated. As such, the electrical connector system defines a mezzanine connector system with the electrical connectors 102, 104 arranged between the parallel circuit boards 106, 108. The signal paths or electrical paths through the electrical connectors pass linearly or axially between the circuit boards 106, 108. Optionally, the connectors 102, 104 may have variable heights to provide a desired distance (or fit) between the parallel circuit boards 106, 108. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board mounted.

In the illustrated embodiment, the header connector 104 includes a header housing 112 and a plurality of header contacts 114. The header housing 112 extends between a mating end 122 and a mounting end 124. The header housing 112 includes multiple outer walls that define a chamber 120 therebetween. For example, the header housing 112 may include opposite sides 115, 116 and opposite ends 117, 118; however the header housing 112 may have other walls defining other shaped housings. Optionally, the sides 115, 116 are longer than the ends 117, 118 and thus the sides 115, 116 extend in a longitudinal direction and the ends 117, 118 extend in a lateral direction.

The chamber 120 is open at the mating end 122 of the header housing 112 and is configured to receive a portion of the mezzanine connector 102 therein. All or at least some of the outer walls may be beveled at the mating end 122 to provide a lead-in section to guide the mezzanine connector 102 into the chamber 120 during mating. In the illustrated embodiment, the header housing 112 has a fixed height between the mating end 122 and the mounting end 124. The header housing 112 may be formed of at least one dielectric material, such as a plastic or one or more other polymers. A base wall (not shown) is provided at or near the mounting end 124 that closes the bottom of the chamber 120. The mounting end 124 of the header housing 112 faces, and may also engage, a surface of the second circuit board 108.

The header contacts 114 may define signal contacts and ground contacts arranged in an array, such as along rows and columns in the chamber 120. Optionally, the ground contacts may be longer than the signal contacts to form a sequenced mating interface for mating with the mezzanine connector 102. The contacts 114 are formed of a conductive material, such as copper, a copper alloy, and/or another metal or metal alloy. In the illustrated embodiment, the contacts 114 include flat blades at mating ends thereof that extend into the chamber 120; however the contacts 114 may have other mating interfaces in alternative embodiments, such as spring beams, sockets, pins, and the like. The contacts 114 also include terminating segments (not shown) that are configured to engage and electrically connect to a corresponding conductor (not shown) of the circuit board 108. The conductors of the circuit board 108 may be electric pads or traces, plated vias, or the like. In various embodiments, the terminating segments of the contacts 114 are compliant pins, such as eye-of-the-needle pins, which are received in plated vias of the circuit board 108.

The mezzanine connector 102 includes a housing stack 200 that extends between a mating end 222 and a mounting end 224. The housing stack 200 is modular and includes at least a front housing 210 and a rear housing 212, which are stackable units. The mezzanine connector 102 holds a plurality of contacts 214 (shown in FIG. 3), which may include both signal contacts and ground contacts. The contacts 214 extend through the front and rear housings 210, 212 and are provided at or near both the mating end 222 and the mounting end 224 for termination to the header connector 104 and circuit board 106, respectively.

Optionally, the rear housing 212 may be replaceable with one of many different rear housings 212, such as rear housings 212 having different heights, that are matable to the same front housing 210 to change the stack height of the housing stack 200. A particular rear housing 212 is selected to provide a particular size or height mezzanine connector 102 depending on the particular application and/or spacing needed between the circuit boards 106, 108. The rear housing 212 is positioned or located rearward of the front housing 210.

The mezzanine connector 102 includes a lossy spacer 202 held by the front housing 210 and/or the rear housing 212. In an exemplary embodiment, the lossy spacer 202 is sandwiched between the front housing 210 and the rear housing 212. The lossy spacer 202 is manufactured from lossy material configured to absorb at least some electrical resonance that propagates along the current path defined by the signal contacts and/or the ground contacts through the mezzanine connector 102 between the mating and mounting ends 222, 224. The lossy material provides lossy conductivity and/or magnetic lossiness through a portion of the mezzanine connector 102.

The lossy material is able to conduct electrical energy, but with at least some loss. The lossy material is less conductive than the conductive material of the contacts 214. The lossy material may be designed to provide electrical loss in a certain, targeted frequency range. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more.

As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connectors. The thermoplastic material may facilitate the molding of the lossy spacer 202 into the desired shape and/or location. However, many alternative forms of binder materials may be used. Curable materials, such as epoxies, can serve as a binder. Alternatively, materials such as thermosetting resins or adhesives may be used.

As used herein, relative or spatial terms such as "top," "bottom," "front," "rear," "left,", "right", "horizontal", and "vertical" are only used to distinguish the referenced elements and do not necessarily require particular positions or orientations in the electrical connector system 100 or in the surrounding environment of the electrical connector system 100.

Figure 2:
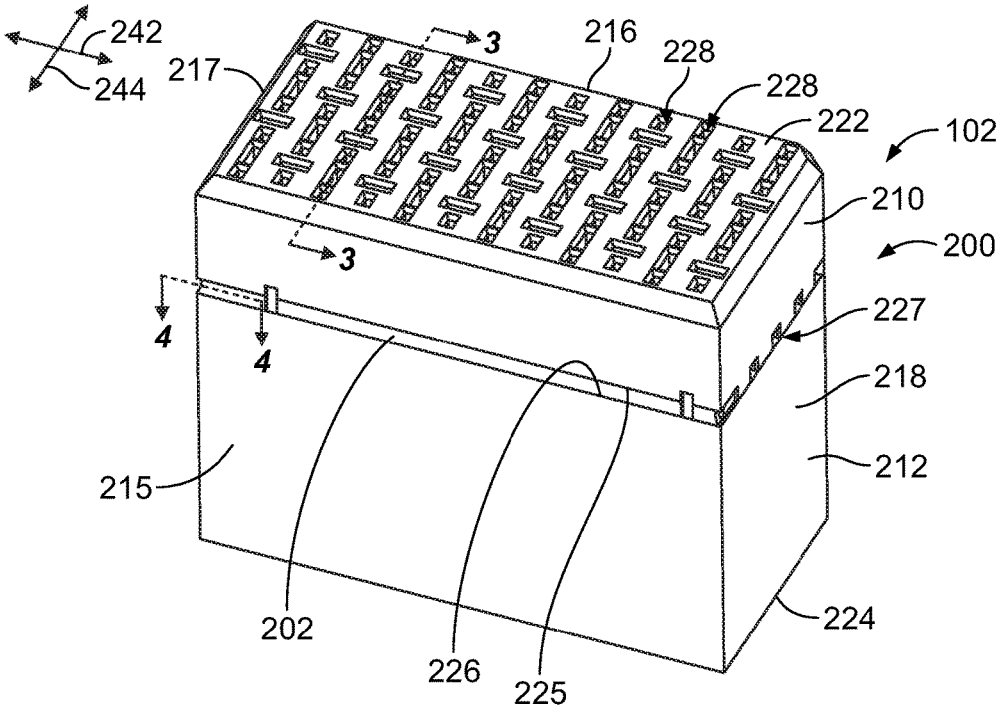
FIG. 2 is a front perspective view of the electrical connector in accordance with an exemplary embodiment.

FIG. 2 is a front perspective view of the mezzanine connector 102 in accordance with an exemplary embodiment. The housing stack 200 includes multiple outer walls that extend between the mating and mounting ends 222, 224. For example, the housing stack 200 may include opposite sides 215, 216 and opposite ends 217, 218 (for example, both the front housing 210 and the rear housing 212 include sides 215, 216 and ends 217, 218); however the housing stack 200 may have other walls defining other shaped housings. Optionally, the sides 215, 216 are longer than the ends 217, 218 and thus the sides 215, 216 extend in a longitudinal direction 242 and the ends 217, 218 extend in a lateral direction 244.

The lossy spacer 202 is sandwiched between the front housing 210 and the rear housing 212. For example, the front and rear housings 210, 212 both include inner ends 225, 226 facing each other at a seam 227 between the front and rear housings 210, 212. The front and rear housings 210, 212 are coupled together at the seam 227. The lossy spacer 202 is arranged at the seam 227. Optionally, the lossy spacer 202 may be received in pockets formed in the front housing 210 and/or the rear housing 212 at the inner end 225 and/or the inner end 226. The lossy spacer 202 may be exposed along the sides 215, 216 and/or the ends 217, 218.

Figure 3:
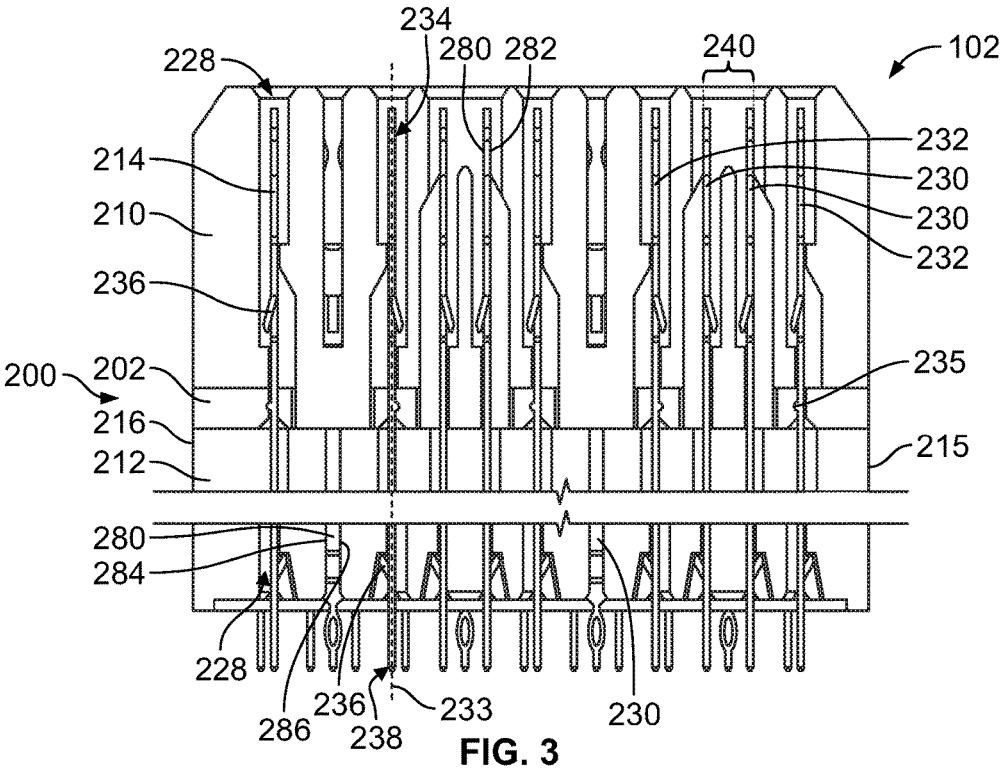
FIG. 3 is a cross-sectional view of the electrical connector taken along line 3-3 shown in FIG. 2.

The housing stack 200 includes contact cavities 228 extending through the front housing 210 and the rear housing 212 that receive corresponding receptacle contacts 214 (shown in FIG. 3). The contacts 214 are arranged in an array, such as along rows and columns, within the housing stack 200. The contacts 214 may be arranged in any number of rows and columns. For example, in the illustrated embodiment, the mezzanine connector 102 includes nine rows and twelve columns of contacts 214. The contact cavities 228 are arranged to accommodate and receive the rows and columns of contacts 214 (for example, the contact cavities 228 are arranged in rows and columns). The layout or pattern of contact cavities 228 is complementary to the layout or pattern of the header contacts 114 for receiving the header contacts 114 during mating of the mezzanine connector 102 with the header connector 104.

Figure 4:
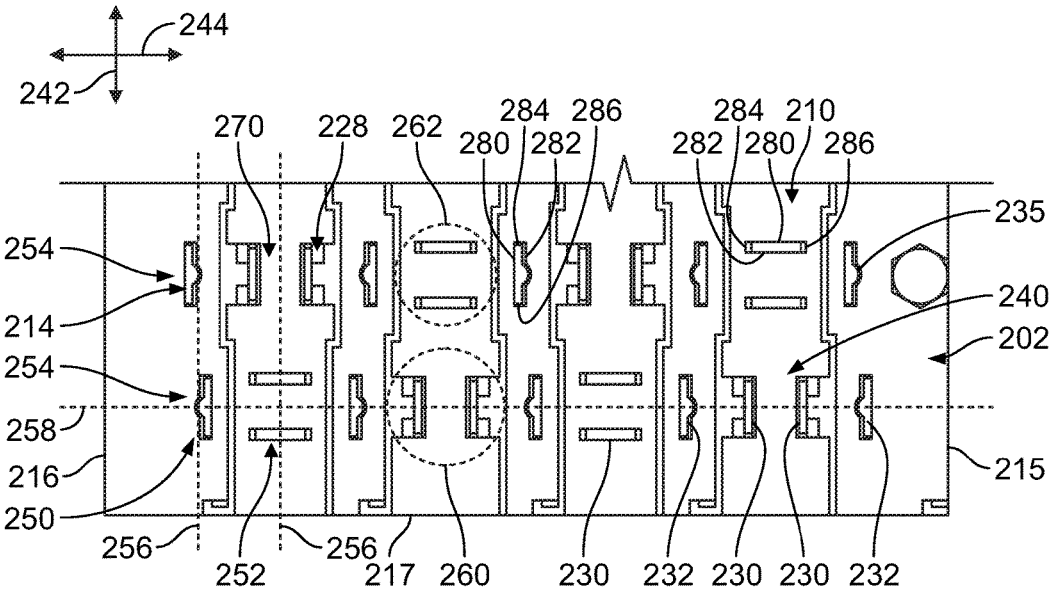
FIG. 4 is another cross-sectional view of a portion of the electrical connector taken along line 4-4 shown in FIG. 2.

FIG. 3 is a cross-sectional view of the mezzanine connector 102 taken along line 3-3 shown in FIG. 2. FIG. 4 is another cross-sectional view of a portion of the mezzanine connector 102 taken along line 4-4 shown in FIG. 2. FIGS. 3 and 4 illustrate the signal and ground contacts 230, 232 arranged in rows and columns, which correspond to the rows and columns of the contact cavities 228. FIGS. 3 and 4 illustrate the arrangement of the lossy spacer 202 within the housing stack 200, showing the lossy spacer 202 interacting with the ground contacts 232 in accordance with an exemplary embodiment.

The receptacle contacts 214 may include both signal contacts and ground contacts, which are identified by reference numbers 230 and 232, respectively. Optionally, the signal contacts 230 and ground contacts 232 may be similar or identical in various embodiments. The layout or pattern of signal and ground contacts 230, 232 is complementary to the layout or pattern of the header contacts 114 (shown in FIG. 1) for mating. The receptacle contacts 214 extend along contact axes 233 between mating ends 234 and terminating ends 238. The contact axes 233 may extend parallel to the sides 215, 216. The receptacle contacts 214 extend through the lossy spacer 202 (for example, the mating ends 234 are located forward of the lossy spacer 202 and the terminating ends 238 are located rearward of the lossy spacer 202). In an exemplary embodiment, the signal contacts 230 extend through the lossy spacer 202 such that the signal contacts 230 do not directly engage the lossy spacer 202. The ground contacts 232 extend through the lossy spacer 202 such that the ground contacts 232 are coupled by the lossy spacer 202. Optionally, the ground contacts 232 may directly engage the lossy spacer 202. In an exemplary embodiment, the ground contacts 232 include protrusions 235 aligned with the lossy spacer 202 that engage the lossy spacer 202. The protrusion 235 defines an interference bump that forces the ground contact 232 to press against the lossy spacer 202. In other embodiments, the ground contacts 232 are coupled by the lossy spacer 202 by being closely coupled to the lossy spacer 202 rather than being directly coupled thereto, such close coupling providing lossy conductivity between the ground contacts 232. As such, the lossy spacer 202 bridges the grounds through either the direct contact or the close coupling.

The receptacle contacts 214 are formed of a conductive material, such as copper, a copper alloy, and/or another metal or metal alloy. In the illustrated embodiment, the contacts 214 include sockets at the mating ends 234 thereof for receiving the blades of the header contacts 114; however the contacts 214 may have other mating interfaces in alternative embodiments, such as spring beams, pins, and the like. The terminating ends 238 are configured to engage and electrically connect to a corresponding conductor (not shown) of the circuit board 106 (shown in FIG. 1). In various embodiments, the terminating ends 238 of the contacts 214 are compliant pins, such as eye-of-the-needle pins, which are received in plated vias of the circuit board 106.

Each receptacle contact 214 includes opposite broad sides 280, 282 and opposite edge sides 284, 286 narrower than the broad sides 280, 282. In an exemplary embodiment, the receptacle contacts 214 are manufactured by stamping and forming the receptacle contacts 214. For example, the receptacle contacts 214 may be stamped from a blank or sheet of stock metal material. The edge sides 284, 286 are defined by the sheared or cut edges during the stamping process. The broad sides 280, 282 are defined by the planar surfaces of the sheet of stock material. Optionally, the receptacle contacts 214 may include retention lances or latches 236 used to hold the receptacle contacts 214 in the contact cavities 228. The retention latches 236 extend from the broad sides 280, 282. The retention latches 236 are captured against corresponding latching surfaces in the housings 210, 212 to hold the receptacle contacts 214 in the contact cavities 228.

In an exemplary embodiment, the signal contacts 230 may be arranged in signal pairs 240 configured to convey differential signals. Select signal pairs 240 may be separated from each other by corresponding ground contacts 232. For example, the ground contacts 232 may flank opposite sides of the signal pairs 240. The ground contacts 232 provide electrical shielding between adjacent signal pairs 240.

The receptacle contacts 214 have a predetermined layout for termination to the circuit board 106 (shown in FIG. 1) and for mating with the header connector 104 (shown in FIG. 1). In an exemplary embodiment, the receptacle contacts 214 are arranged in an array in rows 250, 252 and columns 254. In an exemplary embodiment, both signal contacts 230 and ground contacts 232 are interspersed with each other in each of the columns 254. The rows 250 define ground rows, which may be referred to hereinafter as ground rows 250, and include only ground contacts 232. The rows 252 are signal rows, which may be referred to as signal rows 252, and include only signal contacts 230. In other various embodiments, the rows 250 and/or 252 may include both signal and ground contacts 230, 232.

The rows 250, 252 extend along row axes 256 and the columns 254 extend along column axes 258. The row axes 256 extend longitudinally, such as in the longitudinal direction 242, and the column axes 258 extend laterally, such as in the lateral direction 244. The row axes 256 extend generally parallel to the sides 215, 216 while the column axes 258 extend generally parallel to the ends 217, 218. FIG. 3 is a cross-section taken along one of the columns 254. FIG. 4 is a cross-section showing two columns 254 and nine rows, in particular four signal rows 252 and five ground rows 250.

As noted above, in an exemplary embodiment, the signal contacts 230 are arranged in pairs 240 in the columns 254 and are arranged in pairs 240 in the signal rows 252. The pairs 240 of signal contacts 230 have alternating horizontal and vertical orientations. For example, within the columns 254, adjacent pairs 240 have alternating horizontal and vertical orientations and, within the signal rows 252, the pairs 240 have alternating horizontal and vertical orientations.

In an exemplary embodiment, each pair 240 of signal contacts 230 defines either a column pair, which is referred to hereinafter as column pair 260, or a cross pair, which is referred to hereinafter as cross pair 262. The signal contacts 230 of each column pair 260 are arranged in-column along a corresponding column axis 258. The signal contacts 230 of each cross pair 262 are arranged across the corresponding column axis 258. For example, the signal contacts 230 within each cross pair 262 flank opposite sides of the corresponding column axis 258 in close proximity to the column axis 258. While neither signal contact 230 of the cross pair 262 lies directly on the column axis 258 (which splits the pair of signal contacts 230), the pair of signal contacts 230 of the cross pair 262 are considered to be part of the respective column 254 as such signal contacts 230 are both in close proximity to the column axis 258 and associated with the column 254. The field defined between the signal contacts 230 of the cross pair 262 lies across the column axis 258. Similarly, the signal contacts 230 within each column pair 260 flank opposite sides of the corresponding row axis 256 in close proximity to the row axis 256. While neither signal contact 230 of the column pair 260 lies directly on the row axis 256 (which splits the pair of signal contacts 230), the pair of signal contacts 230 of the column pair 260 are considered to be part of the respective row 252 as such signal contacts 230 are both in close proximity to the row axis 256 and associated with the row 252.

Optionally, the ground contacts 232 in the ground rows 250 may be staggered along the row axes 256. For example, some of the ground contacts 232 may be shifted to one side of the corresponding row axis 256 while other ground contacts 232 may be shifted to the other side of the corresponding row axis 256. The ground contacts 232 are staggered to accommodate and provide space for the column pairs 260. While the ground contacts 232 are slightly staggered along the row axis 256, the ground contacts 232 are considered to be part of the respective row 250 as such ground contacts 232 are in close proximity to the row axis 256 and associated with the row 250.

Adjacent signal pairs 240 of the signal contacts 230 along the column axes 258 alternate between column pairs 260 and cross pairs 262. Similarly, adjacent signal pairs 240 of signal contacts 230 along the row axes 256 alternate between column pairs 260 and cross pairs 262. Each column pair 260 is surrounded on all populated sides by cross pairs 262, and similarly, each cross pair 262 is surrounded on all populated sides by column pairs 260.

The signal contacts 230 within each pair 240 are separated by a gap 270. The gap 270 between the signal contacts 230 of each column pair 260 is in-column along the corresponding column axis 258 with the signal contacts 230 of the column pair 260. The gap 270 between the signal contacts 230 of each cross pair 262 is aligned with the column axis 258 of the corresponding column 254. Similarly, the gap 270 between the signal contacts 230 of each cross pair 262 is in-row along the corresponding row axis 256 with the signal contacts 230 of the cross pair 262. The gap 270 between the signal contacts 230 of each column pair 260 is aligned with the row axis 256 of the corresponding row 252.

The ground contacts 232 are arranged between adjacent pairs 240 of signal contacts 230 in the corresponding columns 254. The ground contacts 232 thus provide electrical shielding between the pairs 240 of signal contacts 230 in the column 254. In an exemplary embodiment, the ground contacts 232 are arranged along the column axes 258. The ground contacts 232 are arranged in-column between each alternating cross pair 262 and column pair 260 in the column 254. In an exemplary embodiment, each column pair 260 is flanked on opposite sides, in the column 254, by ground contacts 232.

In an exemplary embodiment, the array of receptacle contacts 214 includes alternating ground and signal rows. For example, in the illustrated embodiment, the mezzanine connector 102 includes a first ground row 250, a second signal row 252, a third ground row 250, a fourth signal row 252, a fifth ground row 250, a sixth signal row 252, a seventh ground row 250, an eighth signal row 252, and a ninth ground row 250; however, greater or fewer rows may be provided in alternative embodiments. In the illustrated embodiment, each column 254 has a contact scheme of ground contact 230, column pair 260 of signal contacts 230, ground contact 230, cross pair 262 of signal contacts 230, and ground contact 230, and may include additional ground and signal contacts 232, 230 above and/or below such contact scheme.

The broad sides 280, 282 of the signal contacts 230 of the column pair 260 are parallel to the corresponding column axis 258. The broad sides 280, 282 of the signal contacts 230 of the cross pair 262 are perpendicular to the column axis 258 and/or parallel to the row axis 256. The broad sides 280, 282 of the signal contacts 230 of the cross pair 262 are equidistant from the edge sides 284 or 286 of the signal contacts 230 of the nearest column pair 260 in the same column 254 to such cross pair 262. The broad sides 280, 282 of the signal contacts 230 of the column pair 260 are equidistant from the edge sides 284 or 286 of the signal contacts 230 of the nearest cross pair 262 in the adjacent column 254 to such column pair 260. Such a symmetric arrangement of the column pairs 260 and cross pairs 262 provides signal or noise cancelling for the differential pairs of signal contacts 230 for signal integrity, such as between pairs 240 in different columns 254. The noise cancelling effect mitigates the need for shielding between the columns 254, such as using ground contacts 232, eliminating the need for columns of ground contacts 232 between the columns of signal contacts 230. The signal contacts 230 may thus be more tightly or densely populated within the footprint of the receptacle housing 212.

The lossy spacer 202 is interspersed through the mezzanine connector 102, such as in each of the ground rows 250. In an exemplary embodiment, the lossy spacer 202 does not span across any of the signal rows 252. The lossy spacer 202 bridges the ground contacts 232 within the corresponding ground rows 250 to electrically tie such ground contacts 232 together. The ground contacts 232 flanking opposite sides of the pair 240 of signal contacts 230 are not connected with the same piece of lossy spacer 202. Rather, such ground contacts 232 on opposite sides of pair 240 are connected by different strips of the lossy spacer 202. Additionally, no lossy material is provided between the pairs 240 of signal contacts 232 within the signal rows 252. The lossy material is only provided between pairs 240 in different signal rows 252. As such, the total amount of lossy material used in the connector is reduced, as compared to a design providing lossy material between the columns of signal pairs 240, which reduces the overall cost of the mezzanine connector 102. Additionally, the signal pairs 240 may be more tightly spaced (denser) by allowing the columns 254 to be positioned closer to each other, as space is not needed between columns 254 for the lossy spacer 202. As such, a smaller overall mezzanine connector 102 may be provided.

Figure 5:
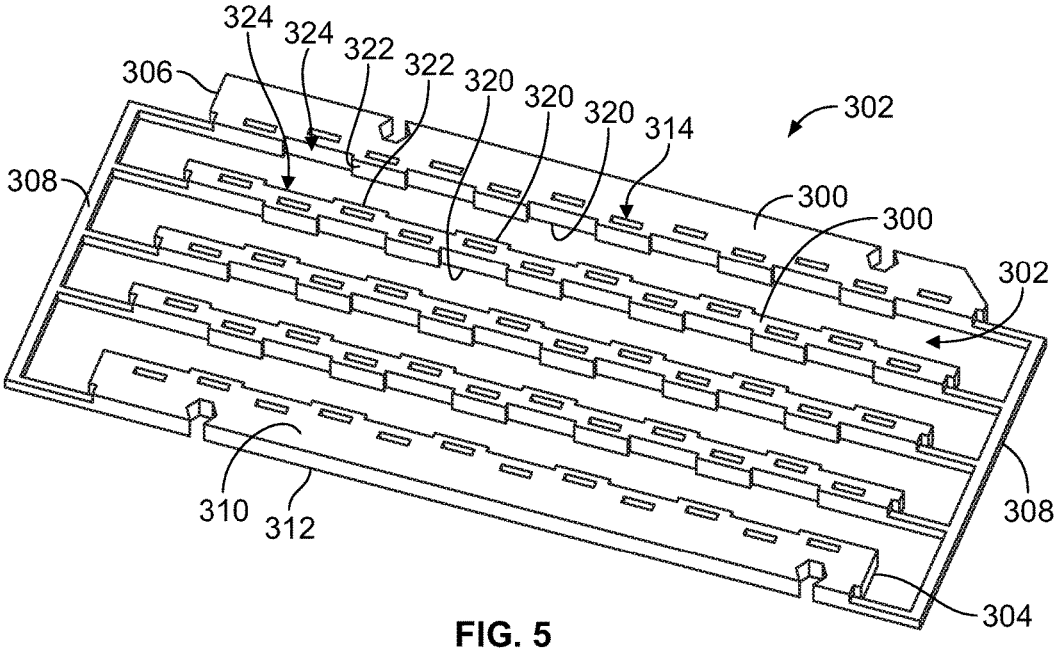
FIG. 5 is a perspective view of a lossy spacer of the electrical connector formed in accordance with an exemplary embodiment.
Figure 6:
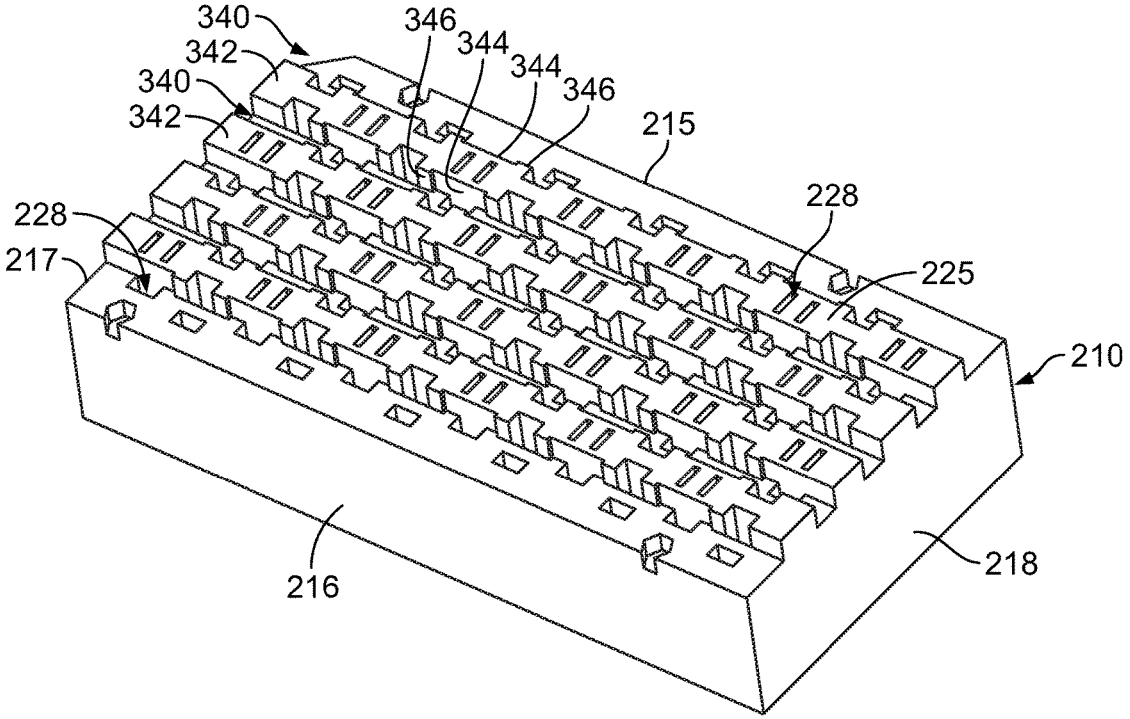
FIG. 6 is a perspective view of a front housing of the electrical connector in accordance with an exemplary embodiment.
Figure 7:
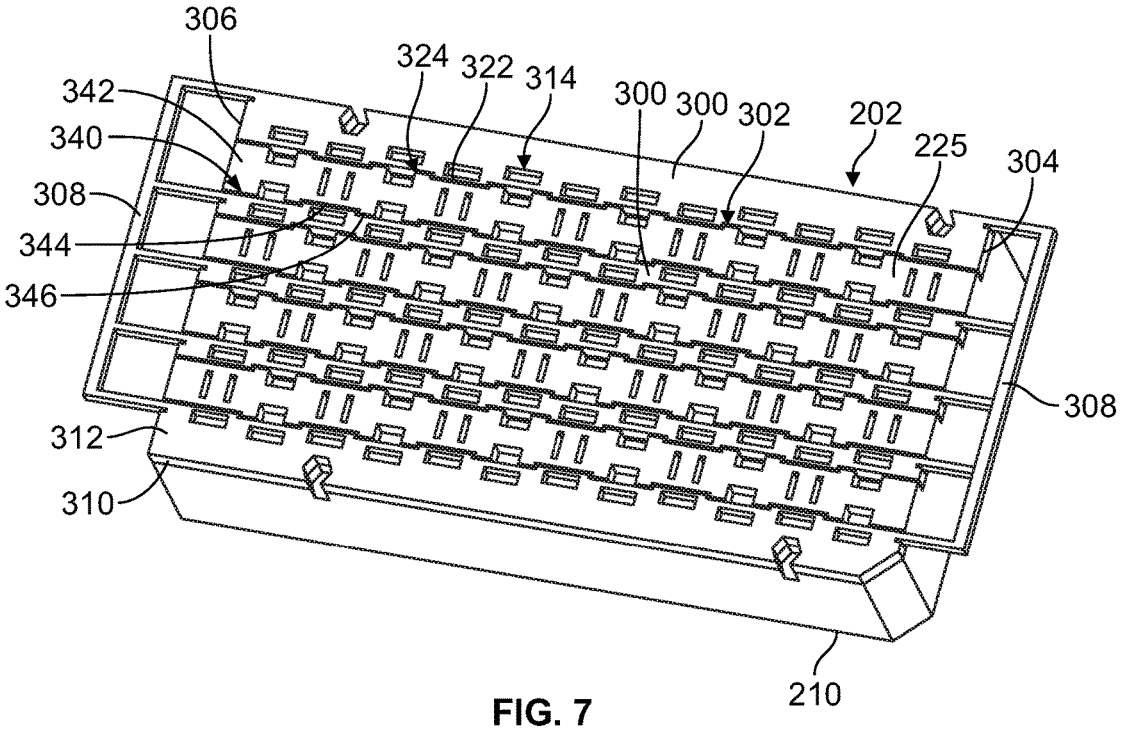
FIG. 7 is a perspective view of the lossy spacer coupled to the front housing.

FIG. 5 is a perspective view of the lossy spacer 202 in accordance with an exemplary embodiment. FIG. 6 is a perspective view of the front housing 210 in accordance with an exemplary embodiment. FIG. 7 is a perspective view of the lossy spacer 202 coupled to the front housing 210. Optionally, the lossy spacer 202 is coupled to the inner end 225 of the front housing 210 such that the lossy spacer 202 and the front housing 210 are coplanar for mating with the rear housing 212 (shown in FIG. 4).

The lossy spacer 202 includes a plurality of strips 300 separated by gaps 302. The strips 300 extend between opposite first and second ends 304, 306 of the lossy spacer 202.

In an exemplary embodiment, the lossy spacer 202 includes connection bars 308 removably attached to the ends 304 and 306 of the strips 300 (for example, FIG. 1 shows the lossy spacer 202 after the connection bars 308 are removed). The connection bars 308 hold the spacing between the strips 300, such as for placing the lossy spacer 202 on the front housing 210 and/or between the front housing 210 and the rear housing 212 (shown in FIG. 3). The connection bars 308 are configured to be removed after the lossy spacer 202 is disposed between the front and rear housings 210, 212. In an exemplary embodiment, the lossy spacer 202 is formed by a molding process and the connection bars 308 are co-molded with the strips 300. The lossy spacer 202 may be manufactured by other processes in alternative embodiments.

In other various embodiments, rather than having removable connection bars 308, the lossy spacer 202 may include permanent connection bars at the ends 304, 306 that remain connected between the strips 300 within the mezzanine connector 102. In other various embodiments, the lossy spacer 202 may be provided without the connection bars 308.

The lossy spacer 202 includes a front end 310 and a rear end 312 opposite the front end 310. The lossy spacer 202 includes contact cavities 314 extending through the strips 300 between the front and rear ends 310, 312. The contact cavities 314 are configured to receive corresponding ground contacts 232 (shown in FIG. 3).

The strips 300 extend longitudinally between the ends 304, 306. The strips 300 are configured to be received between the front and rear housings 210, 212 such that the strips 300 extend along corresponding ground rows 250 (shown in FIG. 4). The contact cavities 314 receive the ground contacts 232 to electrically connect or tie together all of the ground contacts 232 in the row using the lossy material of the lossy spacer 202. The rows 252 of signal contacts 230 (FIG. 4) are provided in corresponding gaps 302. The strips 300 provide electrical absorption between the various signal rows of signal contacts 230.

The strips 300 have inner edges 320 facing the signal contacts 230 in the gaps 302. Optionally, the contact cavities 314 may be approximately centered between the inner edges 320 of the strips 300. In an exemplary embodiment, the inner edges 320 are non-planar. For example, the inner edges 320 have a series of ribs 322 and pockets 324. The ribs 322 project into the gaps 302 while the pockets 324 are recessed into the strips 300 such that the inner edge 320 is non-planar. Optionally, the ribs 322 along a corresponding inner edge 320 are co-planar with each other and the pockets 324 along corresponding inner edge 320 are co-planar with each other. The ribs 322 and the pockets 324 lock the strips 300 into the front housing 210. For example, the ribs 322 and the pockets 324 may resist translational shifting of the strips 300 relative to housing stack 210.

In an exemplary embodiment, the ribs 322 and the pockets 324 are arranged in an asymmetrical pattern along the strips 300 and across the gaps 302. For example, in an exemplary embodiment, the ribs 322 of the various strips 300 are aligned with the ribs 322 of the adjacent strip 300 across the gap 302. Similarly, the pockets 324 are aligned across the gap 302 with the pockets 324 of the adjacent strip 300. In an exemplary embodiment, the ribs 322 and the pockets 324 are arranged along both inner edges 320 of a given strip 300

(except for the outermost strips) such that the ribs 322 on one inner edge 320 are aligned with the pockets 324 on the other inner edge 320 on the opposite side of the given strip 300.

In FIG. 7, the lossy spacer 202 is shown mated to the front housing 210. For example, the lossy spacer 202 is positioned behind the inner end 225 of the front housing 212 such that the strips 300 are aligned with pockets 340 formed in the front housing 210. The pockets 340 are formed between ribs 342 and/or at the sides 215, 216 of the front housing 210. The ribs 342 have shoulders 344 facing the pockets 340. In an exemplary embodiment, the front housing 210 includes projections 346 along the shoulders 344. The projections 346 may surround portions of the contact cavities 228 extending through front housing 210. When the lossy spacer 202 is coupled to the housing 210, the strips 300 are received in corresponding pockets 340. The gaps 302 receive the ribs 342 of the front housing 210. The projections 346 are received in corresponding pockets 324 along the inner edges 320 of strips 300. The ribs 322 along inner edges 320 of the strips 300 are received between corresponding projections 346.

When assembled (FIG. 7), the inner edges 320 engage the shoulders 344 to secure the strips 300 relative to front housing 210. The strips 300 may be locked into the front housing 210 by the shoulders 344 to stop longitudinal and/or lateral movement of the strips 300. The ribs 342 may substantially fill the gaps 302. In an exemplary embodiment, the pockets 340 extend along corresponding ground rows 250 and the ribs 342 extend along corresponding signal rows 252. Optionally, the rear housing 212 may additionally or alternatively include pockets and ribs similar to pockets 340 and ribs 342 to receive the lossy spacer 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing stack comprising a front housing and a rear housing, the front housing defining a mating end of the housing stack configured for mating with a mating connector, the rear housing defining a mounting end of the housing stack configured for mounting to a circuit board, the mounting end being opposite the mating end, the rear housing disposed rearward of the front housing and being coupled to the front housing at a seam, the housing stack defining plural contact cavities that extend continuously through the front housing and the rear housing between the mating end and the mounting end;

a lossy spacer disposed at the seam between the front and rear housings, the lossy spacer having plural contact cavities aligned with corresponding contact cavities of the housing stack;

signal contacts disposed in corresponding contact cavities of the housing stack and being provided at or near the mating and mounting ends for electrical connection to the mating connector and the circuit board, respectively; and ground contacts disposed in corresponding contact cavities of the housing stack and being provided at or near the mating and mounting ends for electrical connection to the mating connector and the circuit board, respectively;

wherein the signal contacts extend through the lossy spacer such that the signal contacts do not directly engage the lossy spacer, and wherein the ground contacts extend through the contact cavities in the lossy spacer such that the ground contacts are coupled by the lossy spacer.

2. The electrical connector of claim 1, wherein the lossy spacer includes a plurality of strips separated by gaps, the strips having the contact cavities, the ground contacts extending through the strips and engaging the strips, the signal contacts extending through the gaps.

3. The electrical connector of claim 2, wherein portions of the housing stack are received in the gaps.

4. The electrical connector of claim 1, wherein the front housing and the rear housing each have an inner end facing each other at the seam, at least one of the front and rear housing having pockets at the inner end thereof, the lossy spacer being received in the pockets.

5. The electrical connector of claim 1, wherein the signal contacts are arranged in signal rows along corresponding row axes and the ground contacts are arranged in ground rows along corresponding row axes, the lossy spacer being aligned with each of the ground rows.

6. The electrical connector of claim 5, wherein the lossy spacer includes a plurality of strips separated by gaps, the strips being aligned with the ground rows, the gaps being aligned with the signal rows.

7. The electrical connector of claim 5, wherein the lossy spacer connects the ground contacts in same ground rows and does not connect the ground contacts in different ground rows.

8. The electrical connector of claim 1, wherein the lossy spacer includes a plurality of strips arranged generally parallel to each other, the lossy spacer comprises removable connection bars attached to ends of the strips, the connection bars hold a spacing of the strips, the connection bars are removed after the lossy spacer is disposed between the front and rear housings.

9. The electrical connector of claim 1, wherein the lossy spacer is manufactured from a lossy material that absorbs at least some electrical resonance propagating through the electrical connector between the mating end and the mounting end.

10. The electrical connector of claim 1, wherein the lossy spacer is manufactured from a lossy material having conductive particles in a dielectric binder material.

11. The electrical connector of claim 1, wherein the lossy spacer includes a plurality of strips separated by gaps, the strips having inner edges facing the signal contacts, the inner edges being nonplanar.

12. The electrical connector of claim 11, wherein the inner edges have ribs and pockets, the ribs along the inner edges being coplanar and the pockets along the inner edges being coplanar.

13. The electrical connector of claim 11, wherein the ribs and the pockets of a first of the strips are aligned across the corresponding gap with the ribs and the pockets of a second of the strips.

14. The electrical connector of claim 11, wherein the inner edges of a first of the strips define a first inner edge and a second inner edge, the first and second inner edges facing different gaps, the ribs of the first inner edge being aligned with the pockets of the second inner edge, the pockets of the first inner edge being aligned with the ribs of the second inner edge.

15. An electrical connector comprising:

a housing stack comprising a front housing and a rear housing disposed rearward of the front housing and being coupled to the front housing at a seam, the front housing defining a mating end of the housing stack configured for mating with a mating connector, the rear housing defining a mounting end of the housing stack configured for mounting to a circuit board, the housing stack defining plural contact cavities that extend axially through the front housing and the rear housing between the mating end and the mounting end;

signal contacts and ground contacts disposed in corresponding contact cavities of the housing stack and being provided at or near the mating and mounting ends for electrical connection to the mating connector and the circuit board, respectively, the signal contacts being arranged in signal rows along signal row axes and the ground contacts being arranged in ground rows along ground row axes;

a lossy spacer having a plurality of strips disposed at the seam between the front and rear housings, the strips being generally parallel to each other and separated by gaps, the strips being aligned with the ground row axes, the gaps being aligned with the signal row axes;

wherein the signal contacts extend through the gaps in the lossy spacer such that the signal contacts do not directly engage the lossy spacer, and wherein the ground contacts extend through the strips of the lossy spacer such that the ground contacts are coupled by the lossy spacer.

16. The electrical connector of claim 15, wherein the signal contacts are arranged in signal rows along signal row axes and the ground contacts are arranged in ground rows along ground row axes, the lossy spacer being aligned with each of the ground rows, the strips being aligned with the ground rows, the gaps being aligned with the signal rows.

17. The electrical connector of claim 15, wherein the lossy spacer comprises removable connection bars attached to ends of the strips, the connection bars hold a spacing of the strips, the connection bars are removed after the lossy spacer is disposed between the front and rear housings.

18. The electrical connector of claim 15, wherein the strips have inner edges facing the signal contacts, the inner edges being nonplanar.

19. An electrical connector comprising:

a housing stack comprising a front housing and a rear housing disposed rearward of the front housing and being coupled to the front housing at a seam, the front housing defining a mating end of the housing stack configured for mating with a mating connector, the rear housing defining a mounting end of the housing stack configured for mounting to a circuit board, the housing stack having opposite first and second sides and opposite first and second ends extending between the mating and mounting ends, the housing stack defining plural contact cavities that extend axially through the front housing and the rear housing between the mating end and the mounting end;

a lossy spacer having a plurality of strips disposed at the seam between the front and rear housings, the strips being generally parallel to the first and second sides, the strips being separated by gaps, the strips having plural contact cavities aligned with corresponding contact cavities of the housing stack;

signal contacts disposed in corresponding contact cavities of the housing stack and being provided at or near the mating and mounting ends for electrical connection to the mating connector and circuit board, respectively; and ground contacts disposed in corresponding contact cavities of the housing stack and being provided at or near the mating and mounting ends for electrical connection to the mating connector and circuit board, respectively;

wherein the signal contacts extend through the gaps in the lossy spacer such that the signal contacts do not directly engage the lossy spacer, and wherein the ground contacts extend through corresponding contact cavities in the strips of the lossy spacer such that the ground contacts are coupled by the lossy spacer.

20. The electrical connector of claim 19, wherein the signal contacts are arranged in signal rows along signal row axes and ground contacts are arranged in ground rows along ground row axes, the lossy spacer being aligned with each of the ground rows, the strips being aligned with the ground rows, the gaps being aligned with the signal rows.

* * * * *